US005750913A

United States Patent [19]

Kamiya

[11] Patent Number: 5,750,913

[45] Date of Patent: May 12, 1998

[54] MUSIC SYSTEM AND ELECTRONIC MUSICAL INSTRUMENT

[75] Inventor: Ryo Kamiya, Hamamatsu, Japan

[73] Assignee: Yamaha Corporation, Japan

[21] Appl. No.: 653,939

[22] Filed: May 22, 1996

[30] Foreign Application Priority Data

May 23, 1995 [JP] Japan ..... 7-124055

[51] Int. Cl.[6] ..... G10H 7/00

[52] U.S. Cl. ..... 84/625; 84/602; 84/609; 84/622

[58] Field of Search ..... 84/601–602, 604–607, 84/609–610, 622–627, 603

[56] References Cited

U.S. PATENT DOCUMENTS

| | | | |
|---|---|---|---|
| 5,020,410 | 6/1991 | Sasaki | 84/602 |
| 5,119,710 | 6/1992 | Tsurumi et al. | 84/615 |
| 5,198,603 | 3/1993 | Nishikawa et al. | 84/601 |
| 5,200,564 | 4/1993 | Usami et al. . | |
| 5,376,750 | 12/1994 | Takeda et al. . | |
| 5,446,237 | 8/1995 | Abe et al. . | |
| 5,668,336 | 9/1997 | Miyano | 84/605 |

FOREIGN PATENT DOCUMENTS

| | | |
|---|---|---|
| 0 126 962 | 12/1984 | European Pat. Off. . |
| 6 59678 | 3/1994 | Japan . |

*Primary Examiner*—Jonathan Wysock
*Assistant Examiner*—Marlon T. Fletcher
*Attorney, Agent, or Firm*—Graham & James LLP

[57] ABSTRACT

A music system is comprised of a subsystem and a main system. The subsystem includes a first musical tone-synthesizing device that synthesizes musical tones, based on performance data externally supplied thereto, and a mixing device that mixes together the musical tones synthesized by the first musical tone-synthesizing device and external musical tones externally generated and supplied thereto. The main system includes performance data-processing device that controls performance data indicative of musical tones to be performed and transmits the performance data to the subsystem at predetermined timing, and a second musical tone-synthesizing device that synthesizes musical tones, based on the performance data, when the first musical tone-synthesizing device is in a predetermined state. The main system transmits the musical tones synthesized by the second musical tone-synthesizing device to the subsystem, as the external musical tones.

14 Claims, 12 Drawing Sheets

MUSIC SYSTEM AND ELECTRONIC MUSICAL INSTRUMENT

BACKGROUND OF THE INVENTION

1. Field of the Invention

This invention relates to a music system and an electronic musicical instrument which reproduce automatic performance date such as MIDI (Musical Instrument Digital Interface) data.

2. Prior Art

Conventionally, a computer music system, which is sometimes generically called an electronic musical instrument, is known, which reads out automatic performance data such as MIDI data stored in a floppy disk or a hard disk, and synthesizes musical tones according to the automatic performance data, by the use of an FM (frequency modulation) tone generator or a WT (wave table) tone generator, to thereby produce musical sounds.

FIG. 1 shows the arrangement of an example of the conventional computer music system. In the figure, the computer music system is comprised of an ordinary host computer 1 as a main system, and a sound board 10 as a subsystem connected to the main system via a predetermined interface. The host computer 1 has a construction similar to that of an ordinary personal computer, i.e. it is comprised of a CPU 2, a program memory 3, a ROM and a RAM 4, a keyboard and a mouse 5, a CRT 6, a hard disk 7, a floppy disk 8, and an MIDI interface 9.

The CPU 2 reads out performance data such as MIDI data from the hard disk 7 or the floppy disk 8, which are provided as external memory devices, and transmits the performance data to the sound board 10 according to a program (program for automatic performance processing) stored in the program memory 3. The ROM and RAM 4 store a program for starting the host computer 1, and various kinds of data used and/or obtained during execution of programs by the CPU 2. Further, the host computer 1 can carry out preparation and edition of performance data by using the keyboard and mouse 5 and the CRT 6. Besides, the MIDI interface 9 takes in MIDI data from an external device, and sends out MIDI data to an external device.

On the other hand, the sound board 10 is comprised of a CPU 11, a program memory 12, a communication interface 13, a tone generator LSI 14, and a D/A converter 15. The CPU 11 receives MIDI data from the host computer 1 via the communication interface 13, generates musical tone data, based on the MIDI data by the use of the tone generator LSI 14, and converts the musical tone data to analog signals, to thereby generate musical tones by a loudspeaker, not shown, according to a program (program for automatic performance processing) stored in the program memory 12.

FIG. 2 shows the arrangement of another example of the conventional computer music system. In the figure, component parts corresponding to those in FIG. 1 are designated by identical numerals, and description thereof is omitted. The computer music system of FIG. 2 is comprised of an ordinary personal computer 20, and distinguished from the example of FIG. 1 in that the personal computer 20 includes a wave table 21 which stores waveform data indicative of waveforms of musical tones, and a D/A converter 15. The system of FIG. 2 synthesizes and generates musical tones by itself. The CPU 2 reads out performance data such as MIDI data from a hard disk 7 or a floppy disk 8, as external memory devices, then reads out waveform data from the wave table 21, based on the performance data, and converts the waveform data to analog signals, to thereby generate musical tones by a loudspeaker, not shown, according to a musical tone-synthesizing program stored in the program memory 3. In this example, the CPU 2 is capable of carrying out parallel processing, i.e. it can carry out other processings as well as synthesizing and generating musical tones.

FIG. 3 shows a program for synthesizing musical tones, which is executed by the above described computer music system of FIG. 2. At a step S1, performance data such as MIDI data are read out from the hard disk 7 or the floppy disk 8 and interpreted by the CPU 2. Then, at a step S2, it is determined whether or not the MIDI data indicates an ON-state or an OFF-state of any of keys on the keyboard. If the MIDI data does not indicate an ON-state or an OFF-state of a key, the answer is negative (NO), and then the program proceeds to a step, not shown, for executing processing corresponding to the data, description of which is omitted, since the processing is not related to the present invention.

On the other hand, if the MIDI data is key-ON data or key-OFF data, the answer to the question of the step S2 is affirmative (YES), and then the program proceeds to a step S3. At the step S3, a key code of the MIDI data is assigned to a tone-generating channel for generating a musical tone. In a computer music system of this kind, generally, a plurality of channels are provided, and therefore a plurality of musical tones can be simultaneously generated. Following the assignment of the channel, the program proceeds to a step S4, wherein an envelope of the musical tone is formed based on velocity data (velocity of key depression or key release) of the MIDI data. Then, at a step S5, an address in the wave table 21 is determined, which determines which waveform data should be read out, based on the key code of the MIDI data.

Then, at a step S6, the wave table 21 is accessed based on the above determined address, to read out corresponding waveform data. At a step S7, the waveform data is multiplied by the envelope formed at the step S4 to prepare final waveform data (musical tone data), which in turn is delivered to the D/A converter 15. The final waveform data is then converted to an analog signal by the D/A converter 15, followed by generating a musical tone by the loudspeaker. Then, the program proceeds to a step S8, wherein it is determined whether or not the automatic performance is to be terminated. If it is not to be terminated, the answer is negative (NO), and then the program returns to the step S1. On the other hand, if the automatic performance is to be terminated, the answer to the question of the step S8 is affirmative (YES), and then the automatic performance processing is terminated. In FIG. 3, the process of synthesizing a musical tone is expressed in a simplified (schematic) manner. However, the procedure from the step S4 to the step S7 for determining an instantaneous value of a musical tone waveform is repeatedly executed every predetermined sampling period until sounding of the musical tone is completed.

In the conventional computer music system of FIG. 1, which is comprised of the host computer 1 and the sound board 10, all the functions relating to synthesization of musical tones are performed by the sound board 10. Therefore, the capacity of synthesizing musical tones, such as the number of tone-generating channels, is determined by the capacity of the sound board 10. For example, if performance data stored in the hard disk 7 or the floppy disk 8 or performance data such as MIDI data supplied from an external device, etc. are designed for use by a tone generator with a larger capacity than the capacity of the sound board 10, the sound board 10 cannot fully process the performance data. Further, although in recent days a CPU which has an improved processing capacity (processing speed) has been used, the CPU is used only for controlling channels and preparing and editing performance data, resulting in insufficient utilization of the improved processing capacity.

Further, in the conventional computer music system of FIG. 2, which is comprised of the ordinary personal computer 20 having the wave table 21, the synthesization of musical tones is entirely carried out by the use of software. Therefore, if, for example, the number of tone-generating channels is increased, an increased burden is imposed on the program, which adversely affects execution of the other processings which are executed in parallel with the synthesization by the CPU 2. Further, to avoid this inconvenience, merely a simple musical tone-synthesizing algorithm can be employed, resulting in degraded quality of sounds generated, compared with the quality of sounds generated by a system employing an exclusive sound board.

SUMMARY OF THE INVENTION

It is the object of the invention to provide a computer music system and an electronic musical instrument which afford easily improving the capacity of processing musical tones, such as increasing the number of Lone-generating channels.

To attain the object, the present invention provides a music system comprising a subsystem including a first musical tone-synthesizing device that synthesizes musical tones, based on performance data externally supplied thereto, and a mixing device that mixes together the musical tones synthesized by the first musical tone-synthesizing device and external musical tones externally generated and supplied thereto, and a main system including performance data-processing device that controls performance data indicative of musical tones to be performed and transmits the performance data to the subsystem at predetermined timing, and a second musical tone-synthesizing device that synthesizes musical tones, based on the performance data, when the first musical tone-synthesizing device is in a predetermined state, wherein the main system transmits the musical tones synthesized by the second musical tone-synthesizing device to the subsystem, as the external musical tones.

Preferably, the second musical tone-synthesizing device synthesizes musical tones, based on the performance data, when the first musical tone-synthesizing device reaches a limit of processing capacity thereof.

Advantageously, the first musical tone-synthesizing device synthesizes musical tones by hardware.

Also advantageously, the first musical tone-synthesizing device and the second musical tone-synthesizing device operate in parallel to synthesize musical tones, based on the performance data.

Preferably, the first musical tone-synthesizing device and the second musical tone-synthesizing device synthesize musical tones having respective different characteristics.

To attain the same object, the present invention also provides an electronic music instrument comprising a performance data-processing device that controls performance data indicative of musical tones to be performed and transmits the performance data at predetermined timing, a first musical tone-synthesizing device that synthesizes musical tones, based on the performance data, a second musical tone-synthesizing device that synthesizes musical tones, based on the performance data, when the first musical tone-synthesizing device is in a predetermined state, a mixing device that mixes together the musical tones synthesized by the first musical tone-synthesizing device and the musical tones synthesized by the second musical tone-synthesizing device, and a sounding device that generates the musical tones mixed together by the mixing device.

Preferably, the first musical tone-synthesizing device synthesizes musical tones by hardware, and the second musical tone-synthesizing device synthesizes musical tones by software.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
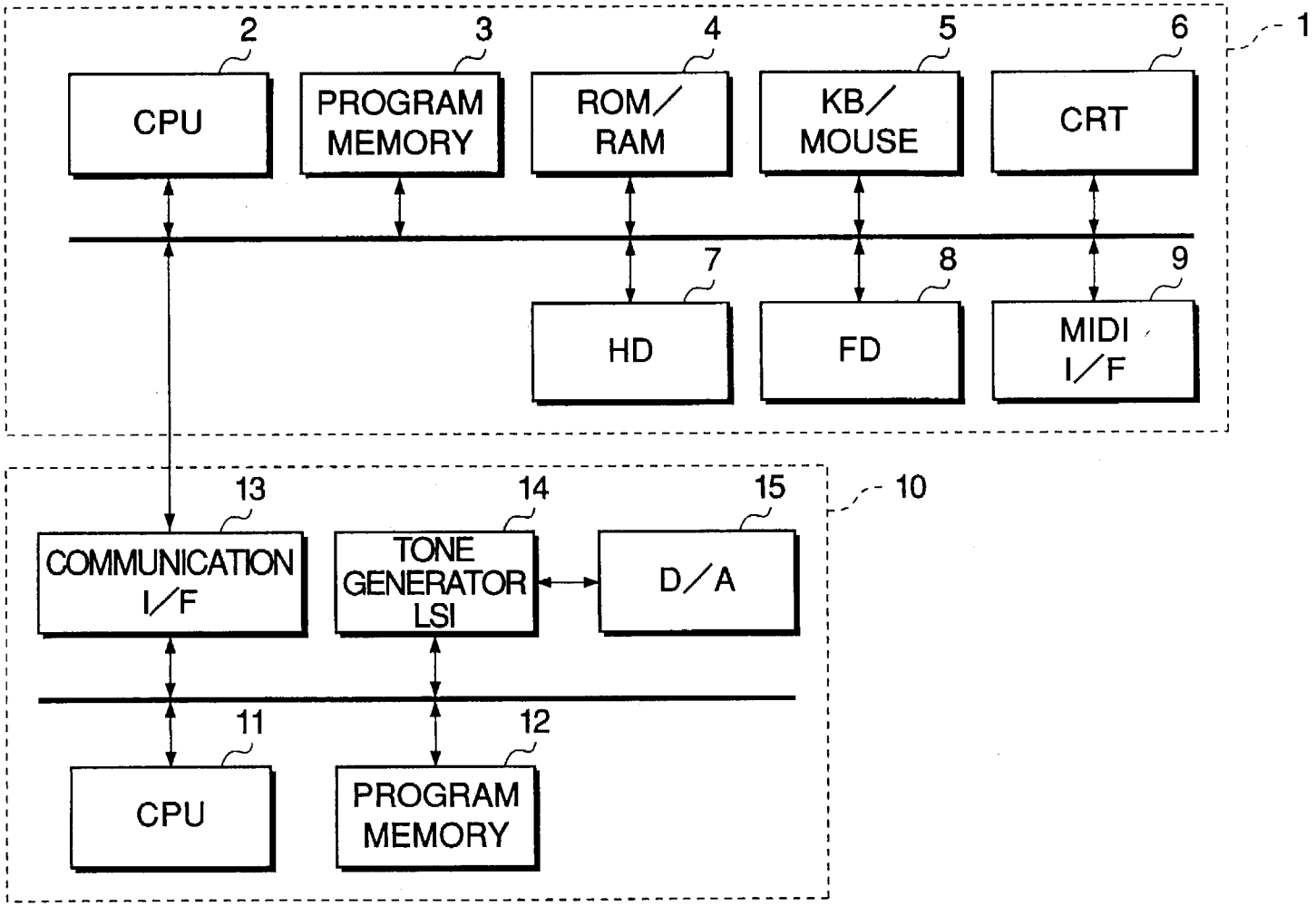
FIG.1 PRIOR ART
FIG. 1 is a block diagram schematically showing the arrangement of a conventional computer music system.
Figure 2:
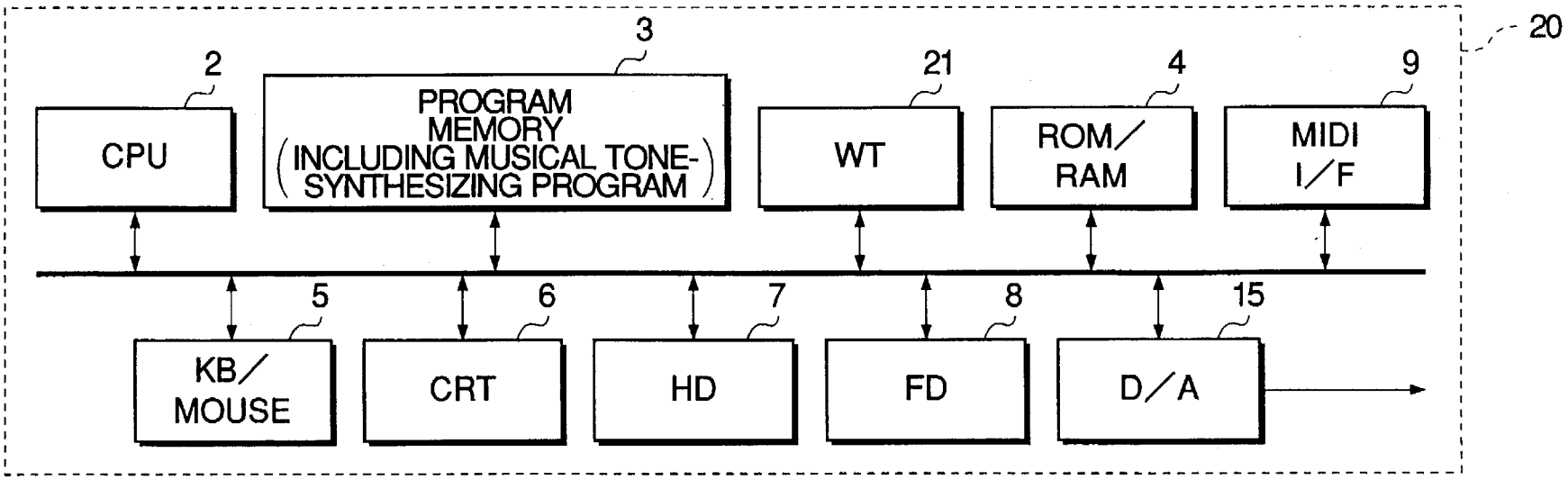
FIG. 2 is a block diagram schematically showing the arrangement of another conventional computer music system.
Figure 3:
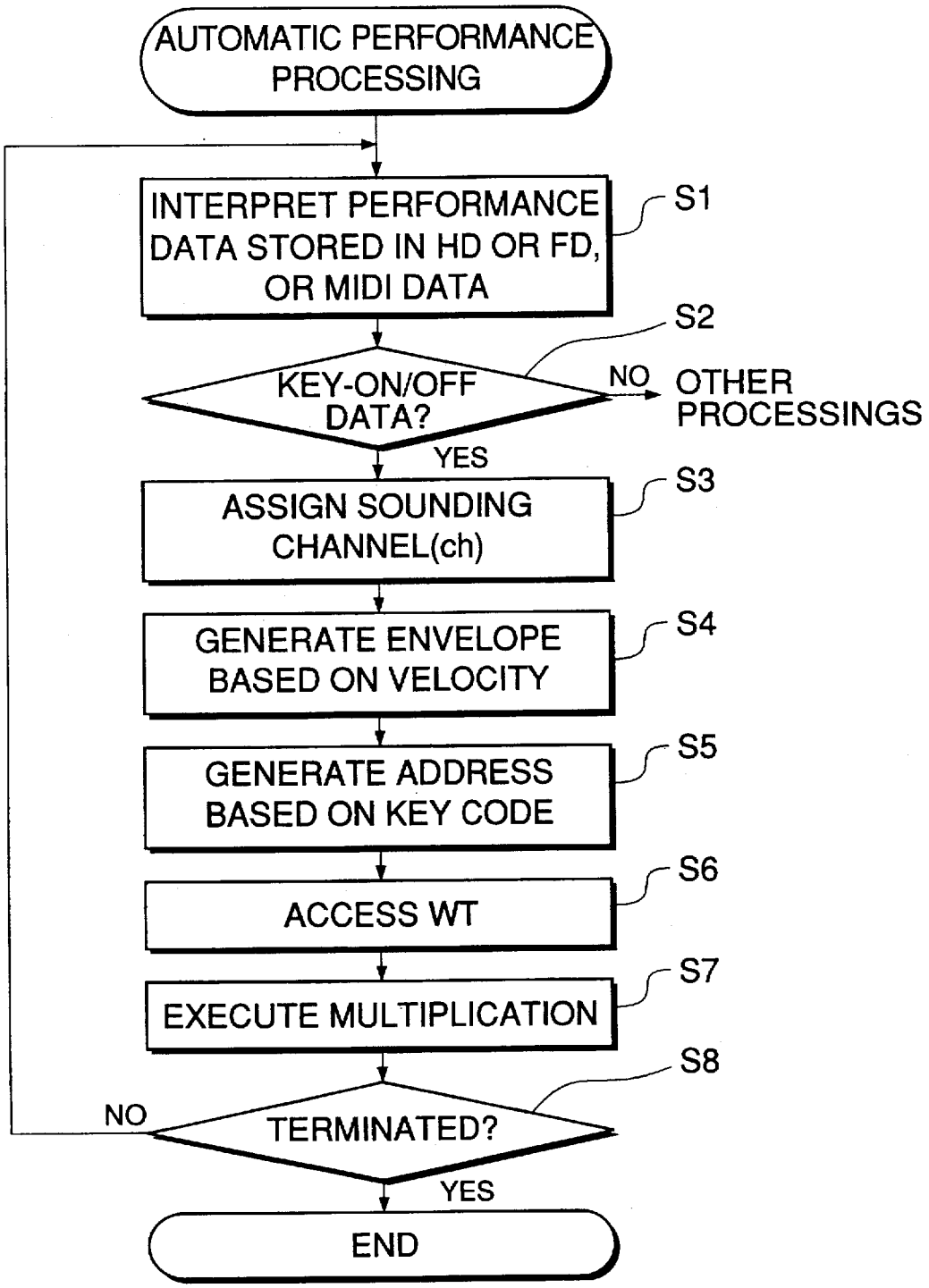
FIG.3 PRIOR ART
FIG. 3 is a flowchart showing a program for synthesizing musical tones by the conventional computer music system in FIG. 2.
Figure 4:
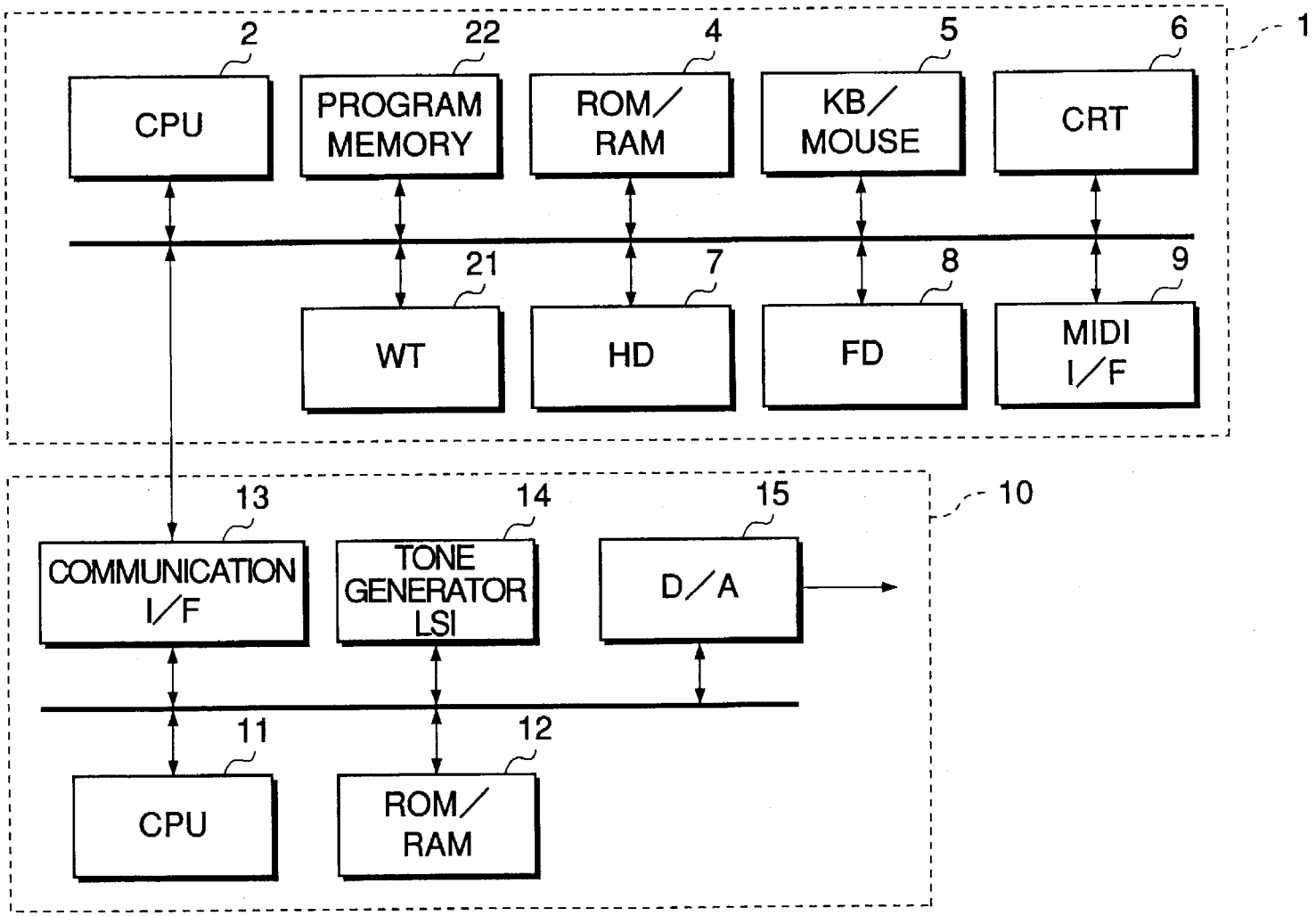
FIG. 4 is a block diagram schematically showing the arrangement of a computer music system according to a first embodiment of the present invention.

Referring first to FIG. 4, there is schematically illustrated the whole arrangement of a computer music system according to a first embodiment of the invention. In FIG. 4, component parts corresponding to those in FIGS. 1 and 2 are designated by identical numerals, and description thereof is omitted. The computer music system according to the first embodiment is comprised of a host computer 30, and a sound board 10 externally connected thereto. As shown in the figure, the host computer 30 is comprised of a wave table 21 which stores waveform data indicative of waveforms of musical tones, and a program memory 22 which stores programs including a musical tone-synthesizing program for synthesizing musical tone data by reading out waveform data from the wave table 21, based on automatic performance data such as MIDI data. A CPU 2 operates on the musical tone-synthesizing program stored in the program memory 22 to read out automatic performance data such as MIDI data from a hard disk 7 or a floppy disk 8, which are provided as external memory devices, and transmit the read-out automatic performance data (MIDI data) to the sound board 10 when an empty channel is present on the sound board 10 side. On the other hand, when no empty channel is present on the sound board 10 side, the CPU 2 reads out waveform data from the wave table 21 provided in the host computer 30, and transmits the read-out waveform data to the sound board 10.

On the other hand, the sound board 10, which has a similar construction to that of the sound board of the conventional computer music system in FIG. 1, receives the MIDI data from the host computer 30 via a communication interface 13 and synthesizes musical tone data by means of a tone generator LSI 14, according to a program stored in a ROM and RAM 12. Then, musical tone data synthesized by the host computer 30 and musical tone data synthesized by the sound board 10 are mixed together, and the mixed musical tone data is converted to an analog signal by means of a D/A converter 15, whereby sound of a musical tone based on the mixed musical tone data is generated from a loudspeaker, not shown. In the sound board 10, most of processings with large burden are executed by the tone generator LSI 14, and therefore the CPU 11, the ROM and RAM 12, and the communication I/F 13 may be omitted from the construction of the sound board 10, if required.

Figure 5:
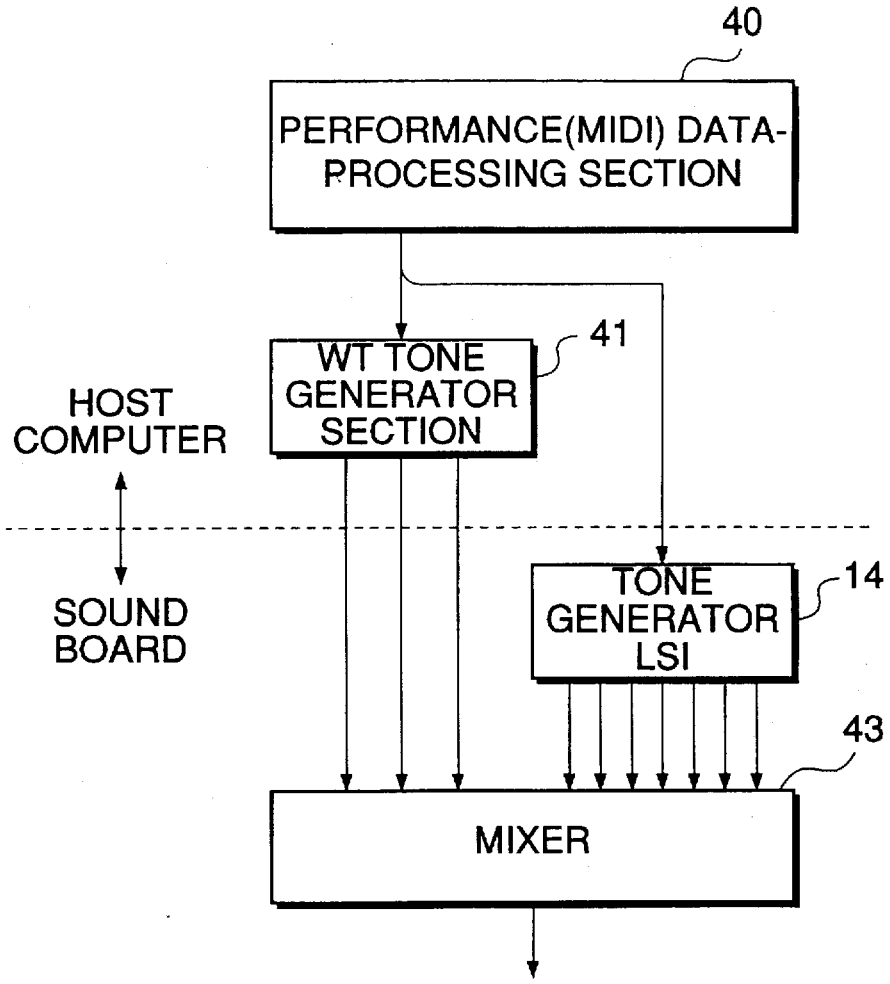
FIG. 5 is a view useful in explaining a manner of synthesizing musical tones according to the first embodiment.

FIG. 5 conceptually represents a manner of synthesizing musical tone data by means of software, which is employed by the computer music system according to the first embodiment. As shown in the figure, in the host computer 30, MIDI data read from the hard disk 7 or the floppy disk 8 is interpreted by a performance data-processing section 40, and transmitted to the tone generator LSI 14 of the sound board 10. On this occasion, if required, at a WT tone generator section 41 of the host computer 30, waveform data is read out from the wave table 21 by software, based on the MIDI data, to synthesize musical tone data from the waveform data. On the other hand, in the sound board 10, musical tone data is synthesized by the tone generator LSI (hardware) 14, based on MIDI data from the host computer 30, and musical tone data synthesized by the host computer 10 and musical tone data synthesized by the sound board 10 are mixed together by a mixer 43 of the sound board 10, to thereby generate sound of the mixed musical tone. Normally, synthesization of musical tones is carried out by the sound board 10. However, when no empty channel is present in the sound board 10, the synthesization is carried out by the host computer 30. As a result, an improvement in the capacity, such as an increase in the number of channels, can be easily attained. As shown in FIG. 5, according to the first embodiment, the host computer 30 has three channels to which musical tone data can be assigned, while the sound board 10 has seven channels to which musical tone data can be assigned.

Figure 6:
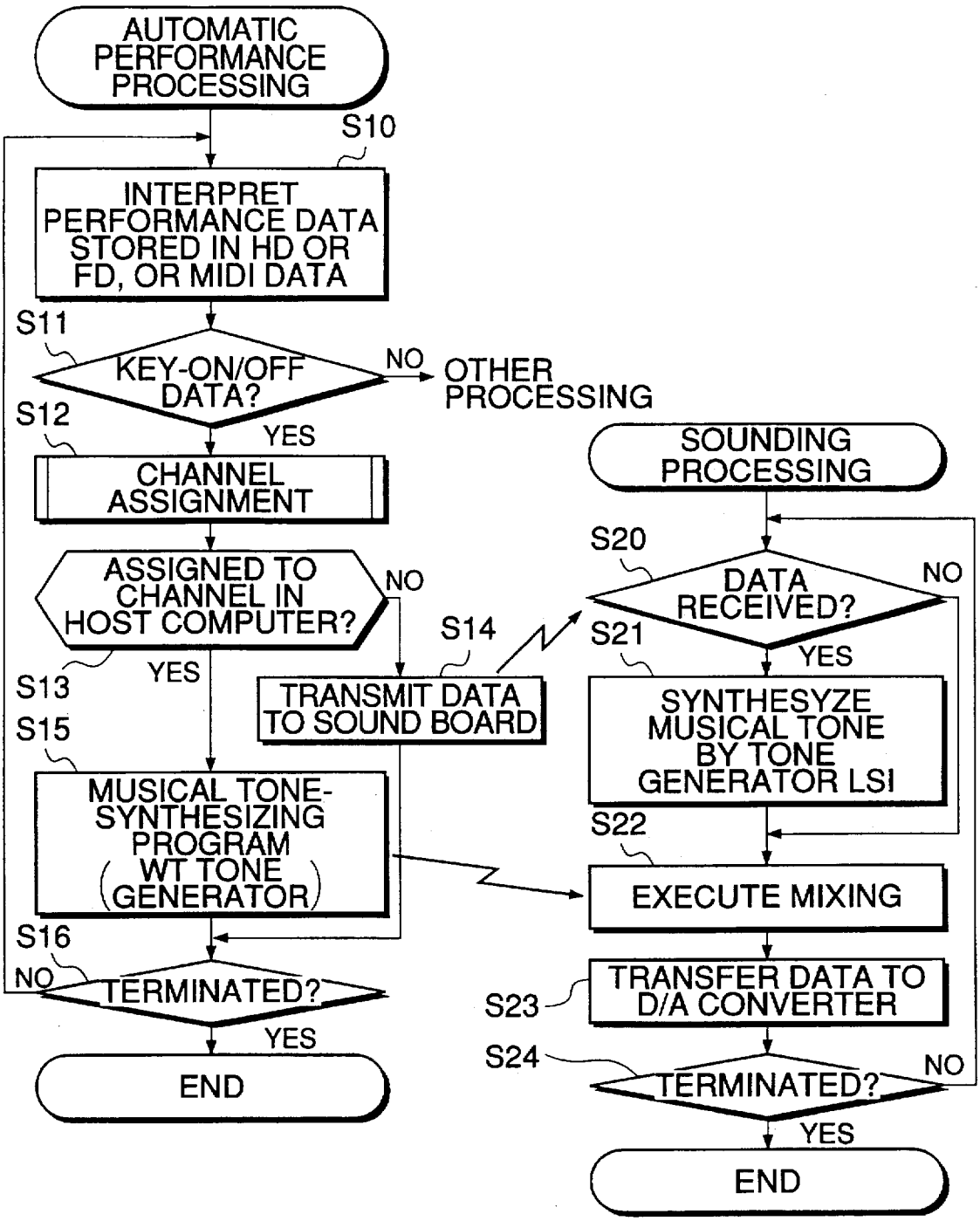
FIG. 6 is a flowchart showing a main routine for synthesizing musical tones, according to the first embodiment.
Figure 7:
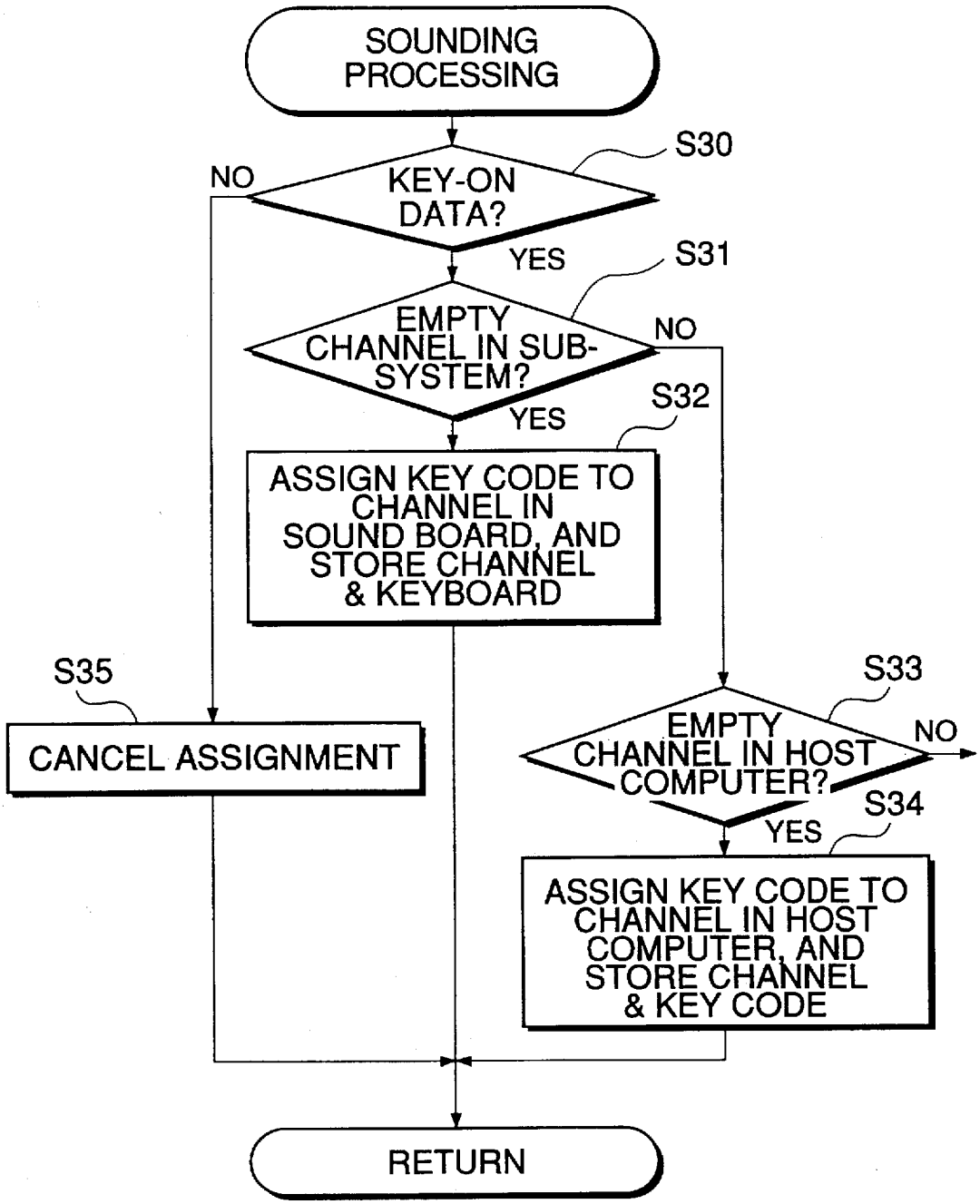
FIG. 7 is a flowchart showing a subroutine for assigning key codes to tone-generating channels.

Next, the operation of the computer music system according to the first embodiment will be described with reference to FIGS. 6 and 7 showing flowcharts of routines for synthesizing musical tones according to the first embodiment.

First, at a step S10 in FIG. 6, in the host computer 30, performance data such as MIDI data stored in the hard disk 7 or the floppy disk 8 is read out and interpreted. Then, at a step S11, it is determined whether or not the MIDI data is key-ON data or key-OFF data. If the MIDI data is neither key-ON data nor key-OFF data, the answer is negative (NO), and then the program proceeds to a step, not shown, for executing a processing corresponding to the MIDI data, description of which is omitted.

On the other hand, if the MIDI data is key-ON data or key-OFF data, the answer to the question of the step S11 is affirmative (YES), and then the program proceeds to a step S12, wherein a key code of the MIDI data is assigned to a tone-generating channel for generating a musical tone. In this channel assignment processing, if there is an empty channel in the sound board 10, the key code is assigned to the empty channel in the sound board 10. On the other hand, if there is no empty channel in the sound board 10, the key code is assigned to an empty channel in the host computer 30. Details of the channel assignment processing will be described hereinafter.

Then, at a step S13, it is determined whether or not assignment of the key data to a channel in the host computer 30 has been made. If assignment of the key data to a channel in the host computer 30 has not been made, i.e. if assignment of the key data to a channel in the sound board 10 has been made, the answer is negative (NO), and then the program proceeds to a step S14. At the step S14, the MIDI data is transmitted via the communication interface 13 to the sound board 10. Then, it is determined at a step S16 whether or not the automatic performance is to be terminated. If it is not to be terminated, the answer is negative (NO), and then the program returns to the step S10. Thus, the steps S10 to S16 are repeatedly executed. In this manner, normally MIDI data are sequentially transmitted to the sound board 10.

On the other hand, in the sound board 10, it is determined at a step S20 whether or not MIDI data has been received from the host computer 30. If MIDI data has been received from the host computer 30, the answer is affirmative (YES), and then the program proceeds to a step S21. At the step S21, musical tone data is synthesized based on the MIDI data by the tone generator LSI 14. Then, at a step S22, if musical tone data synthesized by the host computer 30 has been transmitted to the sound board 10, the transmitted musical tone data and the musical tone data synthesized by the tone generator LSI 14 are mixed together. At a step S23, the mixed musical tone data is transmitted to the D/A converter 15, wherein the mixed musical tone data is converted to an analog signal, whereby musical sound is generated from the loudspeaker.

On the other hand, if there is no empty channel in the sound board 10, the key data is assigned to a channel in the host computer 30. In this case, the answer to the question of the step S13 is affirmative (YES), and then the program proceeds to a step S15. At the step S15, waveform data is synthesized based on the MIDI data according to the musical tone-synthesizing program stored in the program memory 22, and the synthesized waveform data is transmitted to the sound board 10. More specifically, an envelope of the musical tone is formed based on velocity data (velocity of key depression or key release) of the MIDI data, and then an address of the wave table 21 is determined for determining which waveform data should be read out, based on the key code of the MIDI data. Then, the wave table 21 is accessed based on the above determined address, to read out corresponding waveform data. Further, the read-out waveform data is multiplied by the envelope to thereby synthesize final waveform data (musical tone data), followed by transmitting the final waveform data to the sound board 10. Therefore, in this case, the musical tone data (waveform data) transmitted by the host computer 30 at the step S22 and the musical tone data (waveform data) synthesized by the sound board 10 are mixed together, whereby a musical tone based on the mixed musical tone data is generated.

Next, description will be made of the channel assignment processing with reference to a subroutine shown in FIG. 7.

At a step S30 in FIG. 7, it is determined by the host computer 30 whether or not the read-out MIDI data indicates a key-ON event. If it indicates a key-ON event, the answer is affirmative (YES), and then the program proceeds to a step S31. At the step S31, it is determined whether or not an empty channel is present in the sound board 10 which is a subsystem of the computer music system. If the sound board 10 has an empty channel, the answer is affirmative (YES), and then the program proceeds to a step S32. At the step S32, the key code (KC) of the MIDI data is assigned to the empty channel in the sound board 10, and the assigned channel (ch) and the key code (KC) of the MIDI data are stored in the RAM 4 in the host computer 30. Then, the program returns to the main routine of FIG. 6, followed by executing the step S13.

On the other hand, if no empty channel is present in the sound board 10, the answer to the question of the step S31 is negative (NO), and then the program proceeds to a step S33. At the step S33, it is determined whether or not the host computer 30 has an empty channel. If the host computer 30 has no empty channel, i.e. if all the channels in the sound board 10 and the host computer 30 are occupied, the answer is negative (NO). Then, the program proceeds to a step, not shown, wherein sounding of the musical tone is inhibited, or alternatively a musical tone which is just decaying is stopped from being generated, to secure an empty channel to which the key code data is to be assigned.

On the other hand, if the host computer 30 has an empty channel, the answer to the question of the step S33 is affirmative (YES), and then the program proceeds to a step S34. At the step S34, the key code is assigned to the empty channel in the host computer 30 as the tone-generating channel, and the assigned channel (ch) and the key code (KC) of the MIDI data are stored in the RAM 4 in the host computer 30. Then, the program returns to the main routine, followed by executing the step S13.

If the MIDI data does not indicate a key-ON event, i.e. if the MIDI data indicates a key-OFF event, the answer to the question of the step S30 is negative (NO), and then the program proceeds to a step S35. At the step S35, the assignment of the key code to the tone-generating channel is canceled based on the key code (KC) and the channel (ch) stored in the RAM 4, to release the channel from the assignment. Then, the program returns to the main routine, followed by executing the step S13.

As described above, according to the first embodiment, the host computer 30 does not only have a function of controlling empty channels but also a function of synthesizing musical tones by software. Thus, when the sound board 10 has no empty channel, the host computer 30 can synthesize musical tones. As a result, the processing capacity of the entire computer music system is improved, which makes it possible to efficiently synthesize musical tones, and also to increase the number of tone-generating channels and hence increase the number of musical tones which can be simultaneously generated. Besides, the CPU 2 in the host computer 30 can be used for other processing (parallel processing).

Next, a second embodiment of the invention will be described with reference to FIGS. 8 and 9.

Figure 8:
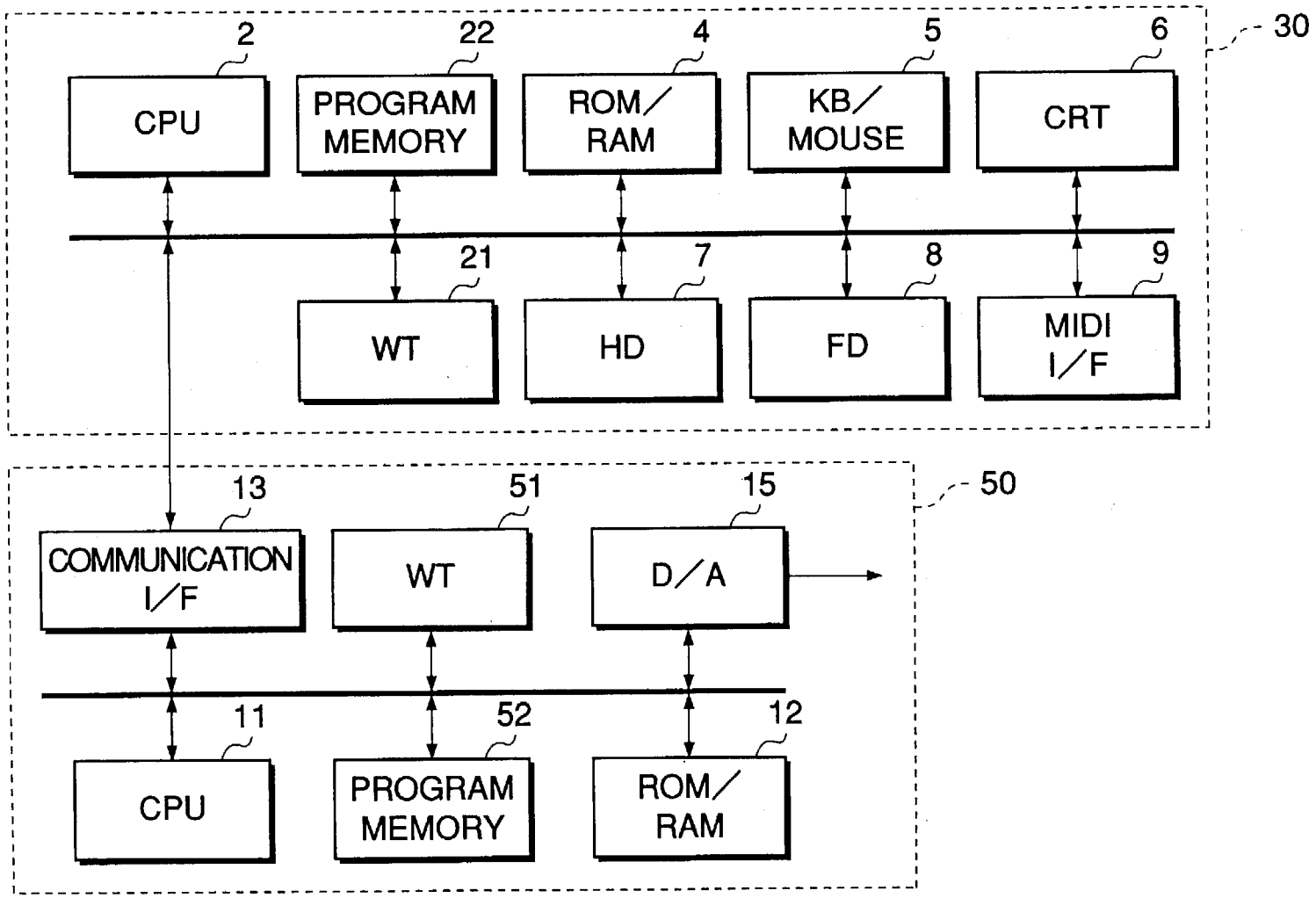
FIG. 8 is a block diagram schematically showing the arrangement of a computer music system according to a second embodiment of the present invention.

FIG. 8 shows the arrangement of a computer music system according to the second embodiment. In the figure, component parts corresponding to those in FIG. 4 are designated by identical numerals, and description thereof is omitted. The computer music system according to the second embodiment is comprised of a host computer 30, and a sound board 50 externally connected thereto, similarly to the first embodiment, and distinguished from the first embodiment in that the sound board 50 also has a wave table 51 which stores waveform data indicative of waveforms of musical tones, and a program memory 52 which stores a musical tone-synthesizing program for synthesizing musical tone data, based on MIDI data etc., by reading out waveform data from the wave table 51, similarly to the host computer 30. That is, the sound board 50 also synthesizes musical tones by software, similarly to the host computer 30.

Figure 9:
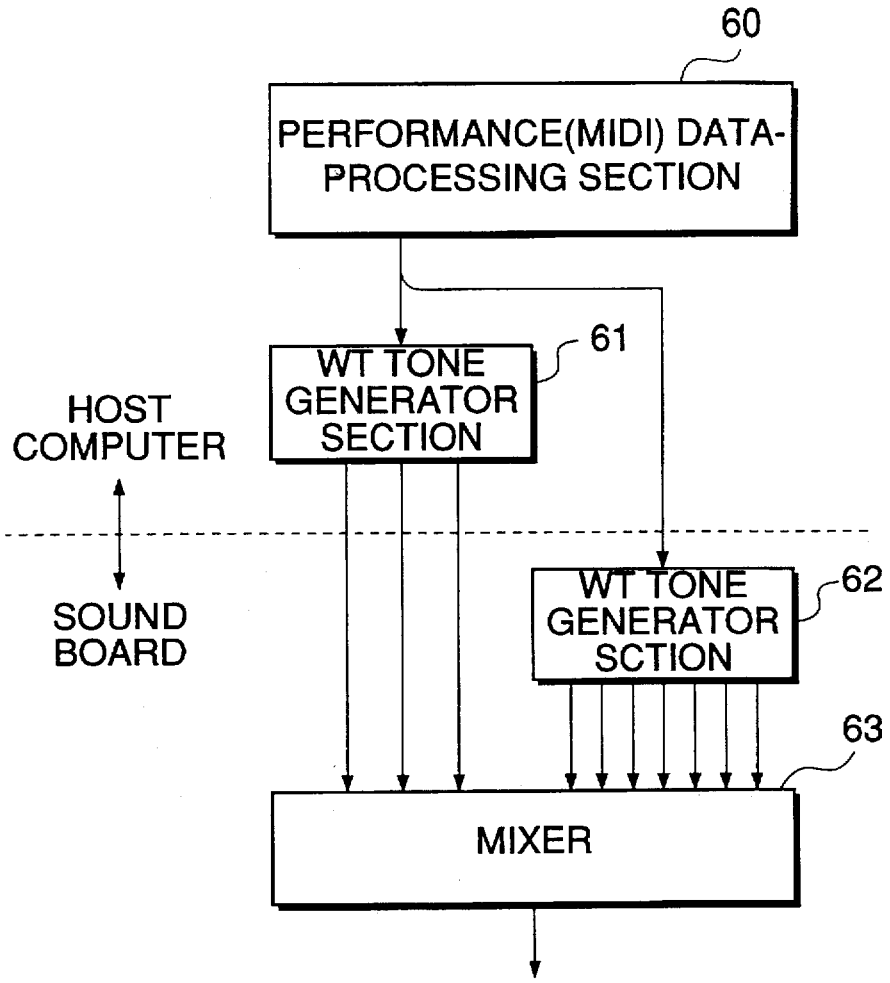
FIG. 9 is a view useful in explaining a manner of synthesizing musical tones according to the second embodiment.

FIG. 9 conceptually represents a manner of synthesizing musical tone data by means of software, which is employed by the computer music system according to the second embodiment. In the host computer 30, MIDI data read from the hard disk 7 or the floppy disk 8 is interpreted by a performance data-processing section 60, and then transmitted to the sound board 50. On this occasion, if required, at a WT tone generator section 61 of the host computer 30, waveform data is read out from the wave table 21 by software, based on the MIDI data, to synthesize musical tone data from the waveform data. On the other hand, at a WT tone generator section 62 of the sound board 50, waveform data is read out from a waveform table 51 by software, based on the MIDI data supplied from the host computer 30, and the musical tone data synthesized by the host computer 30 and the musical tone data synthesized by the sound board 50 are mixed together by a mixer 63 of the sound board 50, to thereby generate sound of the mixed musical tone. Normally, synthesization of musical tones is carried out by the sound board 50. However, when no empty channel is present in the sound board 50, the synthesization is carried out by the host computer 30. As a result, an improvement in the capacity, such as an increase in the number of channels, can be easily attained. The number of channels employed in the second embodiment is identical with that of the first embodiment.

The operation of the computer music system according to the second embodiment is similar to the first embodiment, except in that synthesization of musical tone data in the sound board 10, which is executed at the step S21 in FIG. 6, is carried out according to the musical tone-synthesizing program stored in the program memory 52. More specifically, an envelope of the musical tone is formed based on velocity data (velocity of key depression or key release) of the MIDI data, and an address of the wave table 51 is determined for determining which waveform data should be read out, based on a key code of the MIDI data. Then, the wave table 51 is accessed based on the above determined address, to read out corresponding waveform data. Then, the read-out waveform data is multiplied by the envelope, to thereby synthesize final waveform data (musical tone data).

As described above, according to the second embodiment, the host computer 30 does not only have a function of controlling empty channels but also a function of synthesizing musical tones by software. Further, the sound board 50 has a function of synthesizing musical tones by software, in place of the tone generator LSI (hardware) employed in the first embodiment. Therefore, when the sound board 50 has no empty channel, the host computer 50 can synthesize musical tones. As a result, the whole processing capacity of the computer music system is improved, which makes it possible to efficiently synthesize musical tones, and also to increase the number of tone-generating channels and hence increase the number of musical tones which can be simultaneously generated.

Next, a third embodiment of the invention will be described with reference to FIGS. 10 to 12.

Figure 10:
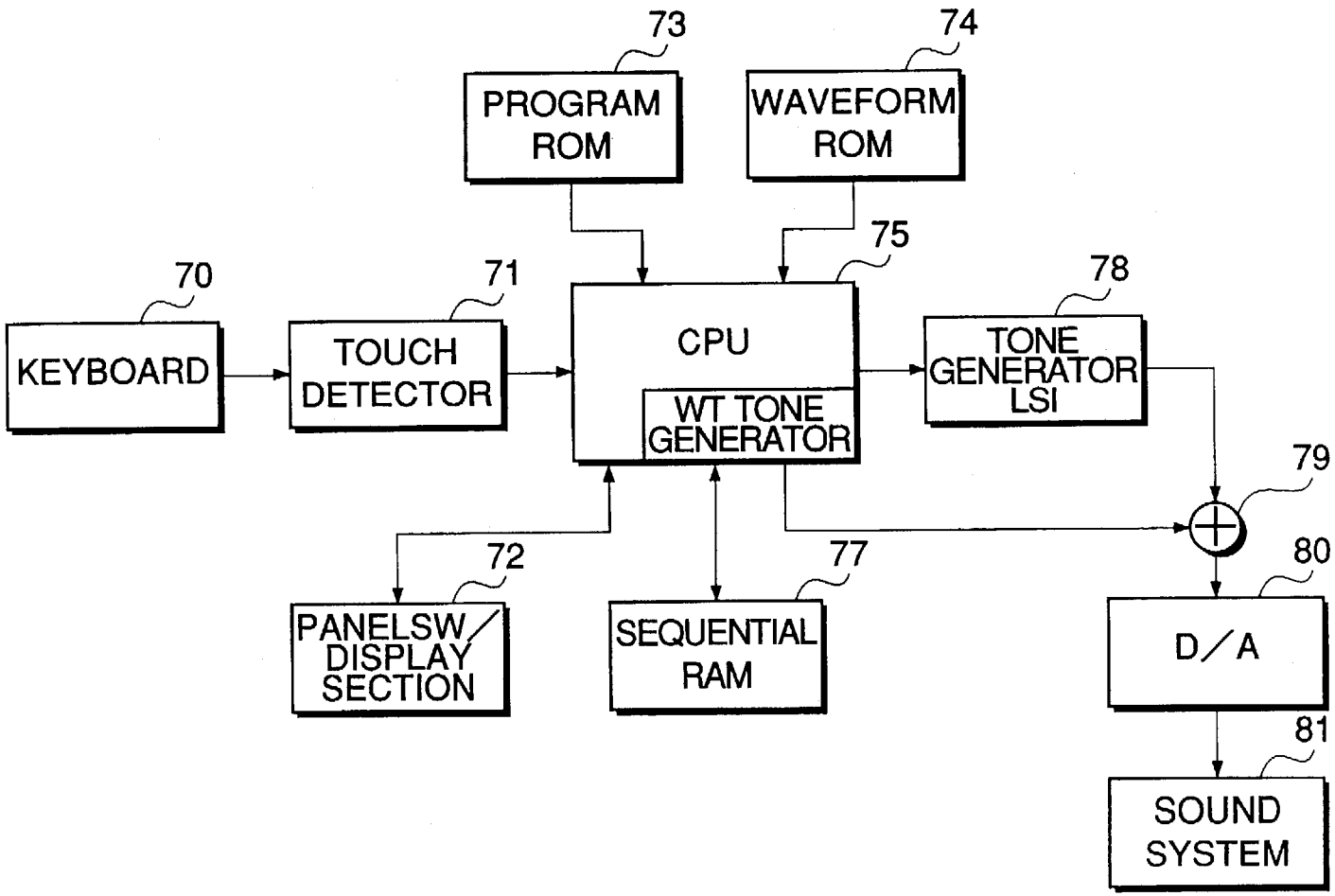
FIG. 10 is a block diagram schematically showing the arrangement of an electronic musical instrument according to a third embodiment of the invention.

FIG. 10 shows the arrangement of an electronic musical instrument according to the third embodiment. The electronic musical instrument is comprised of a keyboard 70, a touch detector 71, a panel switch/display section 72, a program ROM 73, a waveform ROM 74, a CPU 75, a sequential RAM 77, a tone generator LSI 78, an adder 79, a D/A converter 80, and a sound system 81.

The keyboard 70 has a plurality of black keys and a plurality of white keys, to which the touch detector 71 is connected. The touch detector 71 detects the key-ON/OFF states and velocity of depression or release of each key, and supplies signals indicative of the sensed values to the CPU 75. The panel switch/display section 72 is comprised of panel switches for selecting performance-operating modes and tone colors of performance, and a display for displaying various kinds of information.

The program ROM 73 stores programs, such as a musical tone-synthesizing program, according to which various component parts are controlled. The waveform ROM 74 stores waveform data, which are read out under control by the CPU 75 to synthesize musical tone data. The CPU 75 transmits performance data (MIDI data), which are to be synthesized for generation of musical tones, to the tone generator LSI 78, according to various kinds of information (key code, key-ON/OFF states, and velocity) from the touch detector 71 and information on settings by the panel switcher 72. Further, the CPU 75 reads out waveform data from the waveform ROM 74 by using the sequential RAM 77 and supplies the read-out waveform data to the adder 79, according to the musical tone-synthesizing program stored in the program ROM 73. In the figure, a function of synthesizing musical tones according to the above-mentioned musical tone-synthesizing program is represented by a WT (wave table) tone generator 76.

The tone generator LSI 78 generates waveform data, based on the MIDI data supplied from the CPU 75, which is supplied to the adder 79. Whether waveform data indicative of a waveform of a musical tone is to be synthesized by the WT tone generator 76 or by the tone generator LSI 78 depends on the presence/absence of an empty channel in the tone generator LSI 78. That is, if the tone generator LSI 78 has no empty channel, waveform data is generated by the WT generator (software) 76. The adder 79 adds (mixes) together waveform data from the tone generator LSI 78 and waveform data from the WT tone generator 76 and supplies the mixed waveform data to the D/A converter 80. The D/A converter 80 converts the mixed waveform data to an analog signal and supplies the same to the sound system 81. The sound system 81 is comprised of an amplifier and a speaker, neither of which is shown, and converts the analog signal to a musical tone to generate musical sound.

Figure 11:
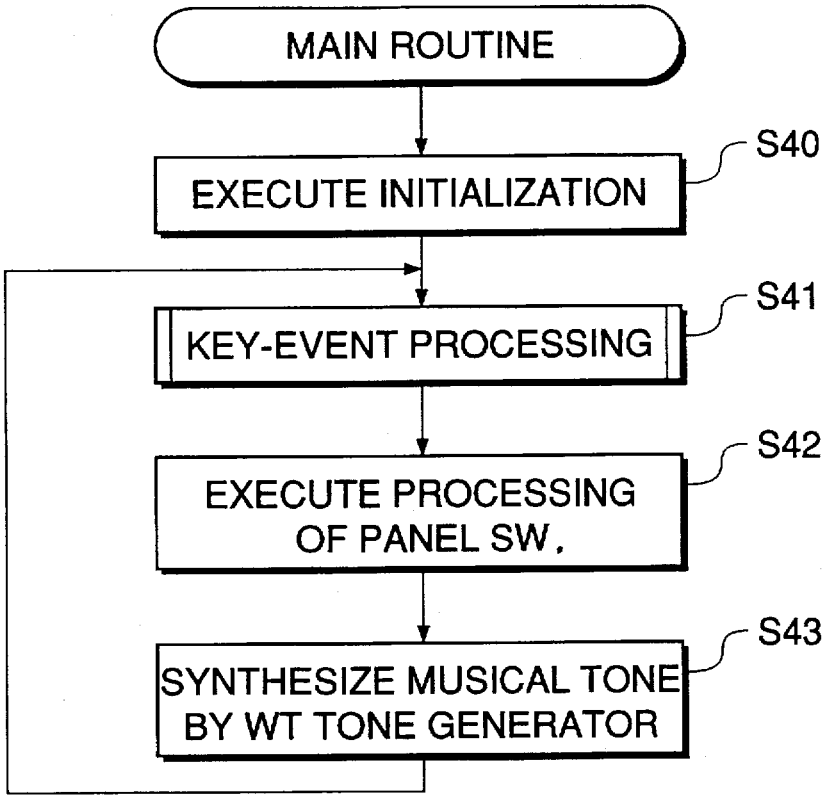
FIG. 11 is a flowchart showing a main routine for synthesizing musical tones, according to the third embodiment.
Figure 12:
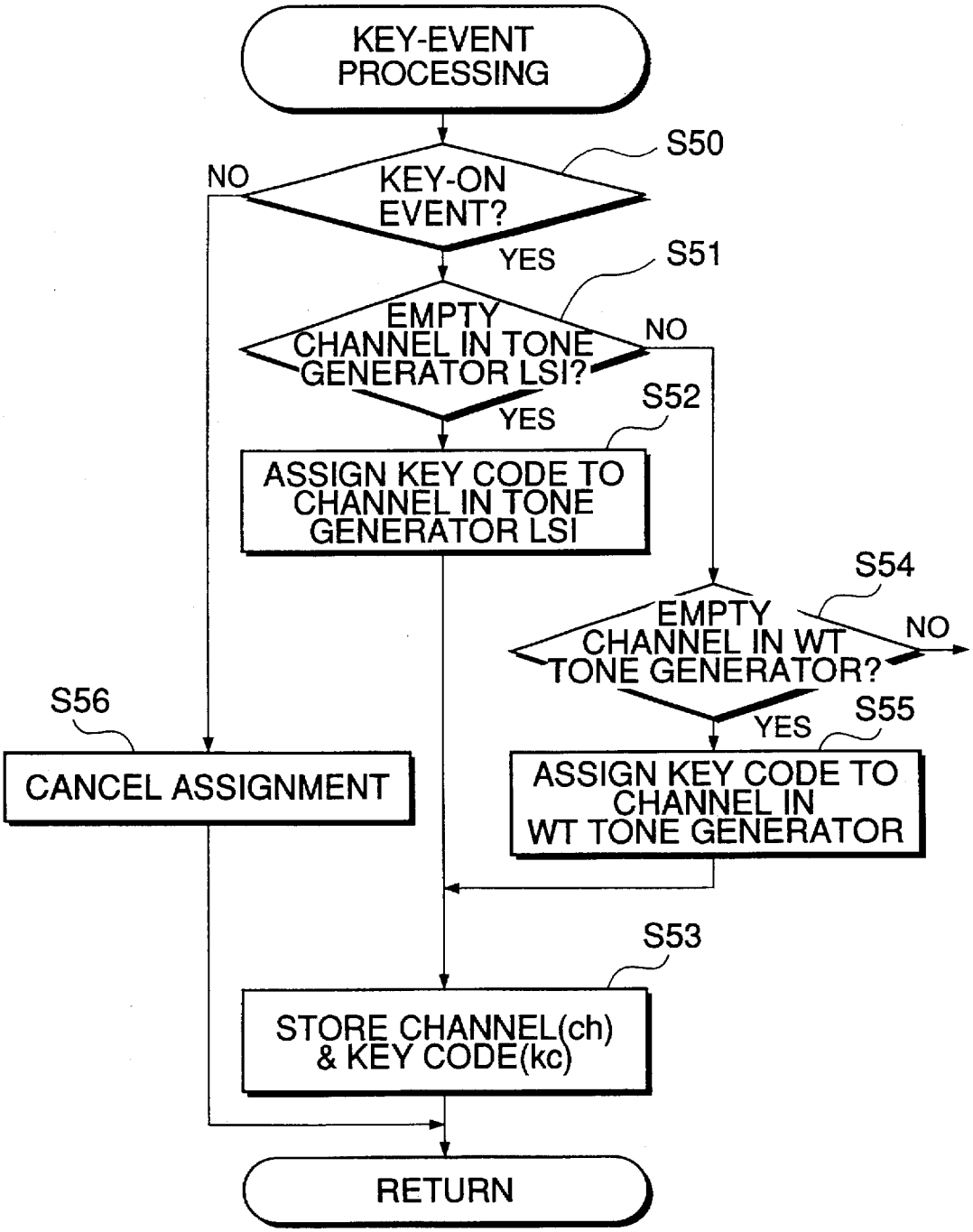
FIG. 12 is a flowchart showing a subroutine for carrying out key-event processing.

FIGS. 11 and 12 show programs for synthesizing musical tones according to the third embodiment.

First, at a step S40 in FIG. 11, initialization, such as clearing of various registers used for giving performance, is executed. Then, at a step S41, key-event processing is executed. In the key-event processing, when a key is depressed, assignment of a corresponding key code to a channel is carried out to determine whether a musical tone corresponding to the key is to be generated by the tone generator LSI 78 or by the WT tone generator 76, or when a key is released, generation of a corresponding musical tone is stopped to release the channel to which the musical tone is assigned. Details of the key-event processing will be described hereinafter. If assignment of a corresponding key code to a tone-generating channel has been made when a key is depressed, the program proceeds to a step S42, wherein inputting of information on settings by the panel switches 72, delivery of data to the display section 72, etc. are carried out. Then, at a step S43, musical tone data is synthesized by the WT tone generator 76 by the use of the waveform ROM 74, according to the musical tone-synthesizing program stored in the program ROM 73. If the key code is not assigned to a channel on the WT tone generator 76 side at the step S41, musical tone data is not synthesized by the WT tone generator 76. Then, the program returns to the step S41, and the steps S41 to S43 are repeatedly executed, to thereby synthesize musical tone data and carry out automatic performance, based on the synthesized musical tone data.

Then, the key-event processing outlined above will be described with reference to a subroutine shown in FIG. 12. First, at a step S50, it is determined whether or not a key has been depressed, i.e. a key-on event has occurred. If a key-on event has occurred, the answer is affirmative (YES), and then the program proceeds to a step S51. At the step S51, it is determined whether or not the tone generator LSI 78 has an empty channel. If the tone generator LSI 78 has an empty channel, the answer is affirmative (YES), and then the program proceeds to a step S52. At the step S52, a key code (KC) of the depressed key is assigned to the empty channel in the tone generator LSI 78, and then at a step S53, the assigned channel (ch) and the key code (KC) are stored, and then the program returns to the main routine of FIG. 11, followed by executing the step S42.

On the other hand, if the tone generator LSI has no empty channel, the answer to the question of the step S51 is negative (NO), and then the program proceeds to a step S54, wherein it is determined whether or not the WT tone generator 76 has an empty channel. If the WT tone generator 76 has an empty channel, the answer to the question of the step S54 is affirmative (YES), and then the program proceeds to a step S55, wherein the key code (KC) of the depressed key is assigned to the empty channel in the WT tone generator 76. Then, at the step S53, the assigned channel (ch) and the key code (KC) are stored, and then the program returns to the main routine of FIG. 11, followed by executing the step S42.

As described above, according to the key processing of the present embodiment, if the tone generator LSI 78 has an empty channel, a key code of a depressed key is assigned to the empty channel in the tone generator LSI 78, whereas if the tone generator LSI 78 has no empty channel, the key code is assigned to an empty channel in the WT tone generator 76. In other words, priority is given to the tone generator LSI 78 which synthesizes musical tones by hardware, and when all the channels in the tone generator LSI 78 are occupied, musical tones are synthesized by software on the WT tone generator side.

On the other hand, if the WT tone generator 76 has no empty channel, either, i.e. if the channels of the tone generator LSI 78 and the WT tone generator 76 are all occupied, the answer to the question of the step S54 is negative (NO), and then the program proceeds to a step, not shown, wherein sounding of the musical tone is inhibited, or alternatively a musical tone which is just decaying is stopped from being generated, to secure an empty cannel to which is then assigned the key code of the presently depressed key.

If the performance data does not indicate a key-on event, i.e. it indicates a key-off event, the answer to the question of the step S50 is negative (NO), and then the program proceeds to a step S56. At the step S56, the assignment of the key code to the tone-generating channel is canceled based on the key code (KC) and the channel (ch) stored in the RAM 4, to release the channel from the assignment. Then, the program returns to the main routine, followed by executing the step S42.

As described above, the electronic musical instrument according to the third embodiment has both the function of synthesizing musical tones by hardware (tone generator LSI 78) and the function of synthesizing musical tones by software (WT tone generator 76), and is constructed such that musical tones are preferentially synthesized by the tone generator LSI 78, while only when the tone generator LSI 78 has no empty channel, musical tones are synthesized by the WT tone generator 76 using software. As a result, the whole processing capacity of the electronic musical instrument is improved, which makes it possible to efficiently synthesize musical tones, and also to increase the number of tone-generating channels and hence increase the number of musical sounds which can be simultaneously generated.

In the above described first to third embodiments, when musical tone-synthesizing means which is given priority in synthesizing musical tones, e.g. a sound board, has no empty channel, other musical tone-synthesizing means, e.g. a host computer, synthesizes musical tones. However, this is not limitative. Alternatively or together with the above arrangement, it may be arranged such that the two musical tone-synthesizing means operate in parallel so that the both means always synthesize musical tones. Further alternatively, it may be arranged such that the two means synthesize musical tones having respective different characteristics, such as tone colors.

The use of parallel processing as mentioned above provides an advantage such as increased applicability of the control by the electronic musical instrument. On the other hand, if the two means synthesize musical tones having respective different characteristics, musical tones can be generated in different manners suitable for respective different characteristic thereof.

Especially, if the two means, e.g. a sound board and a host computer, synthesize musical tones having different characteristics, a function of synthesizing simple musical tones such as rhythm sounds etc. may be allotted to a WT tone generator which synthesizes musical tones by software. This is because a WT tone generator in general is suited for generating musical tones having such tone colors as can be generated simply by reading out PCM waveforms. On the other hand, musical tones (tone colors) requiring a complicated musical tone-synthesizing algorithm may be synthesized by the tone generator LSI. Thus, musical tones can be synthesized by means which are selected depending on characteristics of musical tones to be generated to thereby enable fully exhibiting these characteristics. Therefore, only when the sound board is in a predetermined state, e.g. when no empty channel is present or when special musical tones are to be generated, the other musical tone-synthesizing means, e.g. a host computer, is operated to synthesize musical tones.

As described above in detail, according to the invention, a subsystem of the computer music system normally synthesizes musical tones, however, if first musical tone-synthesizing means of the subsystem is in a predetermined state, second musical tone-synthesizing means of a main system of the computer music system synthesizes musical tones. As a result, the number of musical tones which can be simultaneously generated can be increased, to thereby enable easily improving the processing capacity of the system.

What is claimed is:

1. A music system comprising:

a first system that is used exclusively for synthesizing musical tones, including a first musical tone-synthesizing device that synthesizes musical tones, based on performance data externally supplied thereto, and a mixing device that mixes together said musical tones synthesized by said first musical tone-synthesizing device and external musical tones externally generated and supplied thereto; and a second system having a central processing unit that can synthesize musical tones by executing processing in parallel with other processing, said central processing unit including a performance data-processing device that controls performance data indicative of musical tones to be performed and transmits said performance data to said first system at predetermined timing, and a second musical tone-synthesizing device that synthesizes musical tones, based on said performance data, when said first musical tone-synthesizing device is in a predetermined state;

wherein said second system transmits said musical tones synthesized by said second musical tone-synthesizing device to said first system, as said external musical tones.

2. A music system as claimed in claim 1, wherein said second musical tone-synthesizing device synthesizes musical tones, based on said performance data, when said first musical tone-synthesizing device reaches a limit of processing capacity thereof.

3. A music system as claimed in claim 1, wherein said first musical tone-synthesizing device synthesizes musical tones by hardware.

4. A music system as claimed in claim 1, wherein said first musical tone-synthesizing device and said second musical tone-synthesizing device operate in parallel to synthesize musical tones, based on said performance data.

5. A music system as claimed in claim 4, wherein said first musical tone-synthesizing device and said second musical tone-synthesizing device synthesize musical tones having respective different characteristics.

6. An electronic music instrument comprising:

a performance data-processing device that controls performance data indicative of musical tones to be performed and transmits said performance data at predetermined timing;

a first musical tone-synthesizing device that exclusively synthesizes musical tones, based on said performance data;

a central processing unit that can synthesize musical tones by executing processing in parallel with other processing, said central processing unit including a second musical tone-synthesizing device for synthesizing musical tones, based on said performance data, when said first musical tone-synthesizing device is in a predetermined state;

a mixing device that mixes together said musical tones synthesized by said first musical tone-synthesizing device and said musical tones synthesized by said second musical tone-synthesizing device; and a sounding device that generates said musical tones mixed together by said mixing device.

7. An electronic music instrument as claimed in claim 6, wherein said second musical tone-synthesizing device synthesizes musical tones, based on said performance data, when said first musical tone-synthesizing device reaches a limit of processing capacity thereof.

8. An electronic music instrument as claimed in claim 6, wherein said first musical tone-synthesizing device synthesizes musical tones by hardware, and said second musical tone-synthesizing device synthesizes musical tones by software.

9. An electronic music instrument as claimed in claim 6, wherein said first musical tone-synthesizing device and said second musical tone-synthesizing device operate in parallel to synthesize musical tones, based on said performance data.

10. An electronic music instrument as claimed in claim 9, wherein said first musical tone-synthesizing device and said second musical tone-synthesizing device synthesize musical tones having respective different characteristics.

11. A music system as claimed in claim 2, wherein said first musical tone-synthesizing device synthesizes musical tones by hardware.

12. A music system as claimed in claim 2, wherein said first musical tone-synthesizing device and said second musical tone-synthesizing device operate in parallel to synthesize musical tones, based on said performance data.

13. An electronic music instrument as claimed in claim 7, wherein said first musical tone-synthesizing device synthesizes musical tones by hardware, and said second musical tone-synthesizing device synthesizes musical tones by software.

14. An electronic music instrument as claimed in claim 7, wherein said first musical tone-synthesizing device and said second musical tone-synthesizing device operate in parallel to synthesize musical tones, based on said performance data.

* * * * *